United States Patent [19]

Niles

[11] Patent Number: 4,553,871

[45] Date of Patent: Nov. 19, 1985

[54] DEVICE FOR CLEANING PHONOGRAPH STYLUS

[75] Inventor: Gerald J. Niles, St. Paul, Minn.

[73] Assignee: Minnesota Mining and Manufacturing Company, St. Paul, Minn.

[21] Appl. No.: 585,160

[22] Filed: Mar. 1, 1984

[51] Int. Cl.[4] ..... A47L 13/16; A47L 13/17

[52] U.S. Cl. ..... 401/195; 401/183; 401/196; 401/205; 401/277; 401/281

[58] Field of Search ..... 401/195, 183, 205, 277, 401/281, 196; 132/102, 83 B

[56] References Cited

U.S. PATENT DOCUMENTS

| | | | |
|---|---|---|---|
| 684,172 | 10/1901 | Bick | 132/102 X |
| 979,377 | 12/1910 | Campbell | 401/205 |
| 1,179,080 | 4/1916 | Davis | 401/205 |
| 1,691,024 | 11/1928 | Gedge | 401/205 X |
| 1,859,108 | 5/1932 | Nadoolman | 401/281 X |
| 3,659,952 | 5/1972 | Moransais | 401/196 |
| 3,729,011 | 4/1973 | Gleicher | 132/83 B |
| 4,313,978 | 2/1982 | Stevens et al. | 427/384 |

FOREIGN PATENT DOCUMENTS

| | | | |
|---|---|---|---|
| 1006772 | 4/1952 | France | 401/281 |
| 1063019 | 4/1954 | France | 401/205 |
| 1142591 | 9/1957 | France | 401/205 |
| 1461651 | 12/1966 | France | 401/205 |
| 2250177 | 5/1975 | France | 401/196 |

*Primary Examiner*—Steven A. Bratlie

*Attorney, Agent, or Firm*—Donald M. Sell; James A. Smith; William L. Huebsch

[57] ABSTRACT

Cleaning device includes a cleaning-fluid container on which is mounted a head including a reservoir to which cleaning fluid is valved from the container in an amount sufficient to clean a phonograph stylus without waste. The cleaning is performed with a porous cleaning pad extending across the reservoir. The porous cleaning pad preferably consists of open-cell plastic foam and an exterior velour covering.

9 Claims, 6 Drawing Figures

DEVICE FOR CLEANING PHONOGRAPH STYLUS

TECHNICAL FIELD

The invention deals with the problem of cleaning a phonograph stylus.

BACKGROUND ART

A kit that is sold for cleaning the stylus of a phonograph includes three pieces: a bottle of cleaning fluid, an applicator, and a magnifying mirror for examining the stylus. The cap of the bottle is designed to allow a some of the cleaning fluid to be squirted onto the applicator. Since this requires both hands, the user is not free to lift the arm of the phonograph until after wetting the applicator. After wiping the stylus with the wet applicator, the user may decide that an insufficient quantity of fluid has been applied, in which event the phonograph arm is put down to free both hands for applying more cleaning fluid to the applicator.

DISCLOSURE OF INVENTION

The cleaning device of the present invention allows greater freedom in cleaning a phonograph stylus since it can be used with one hand.

Briefly, the novel cleaning device comprises

- a cleaning-fluid container formed with an orifice,
- a cap mounted over the orifice,
- a head mounted on the cap, which head includes a small reservoir and is formed with an aperture from the reservoir to the exterior,
- the cap and head together forming a valve for allowing cleaning fluid to flow from the container to fill the reservoir, and
- a porous cleaning pad filling said aperture to allow cleaning fluid in the reservoir to be applied to an article such as a phonograph stylus.

The cleaning pad may be coextensive with the reservoir and preferably comprises a flexible, open-cell foam core and an exterior fabric covering which should be a cut-pile fabric. The size of the reservoir should be such that the porous pad receives sufficient cleaning fluid to clean one stylus thoroughly without waste. Approximately 0.5 ml is desirable. Instructions accompanying the novel cleaning device should advise the user to fill the reservoir and then close the valve before cleaning the stylus.

A phonograph arm can be lifted with one hand while simultaneously filling the reservoir and doing the cleaning with the other hand. If it is necessary to refill the reservoir to complete the cleaning, this could be done with one hand without putting down the phonograph arm.

For economy, each of the container, cap and head is a piece of plastic, and the container is a plastic squeeze bottle to enable the reservoir to be filled quickly. The squeeze bottle may be an elongated cylinder with its orifice at one end of the cylinder and with the exterior face of the cleaning pad extending generally parallel to the axis of the cylinder. A mirror may be mounted on the head and brought into position for viewing the stylus by simply turning the cleaning device after cleaning the stylus.

In a preferred cleaning device embodying the invention, the cap is threadably mounted on the container, the head is rotatably mounted on the cap, and the valve is opened and closed by rotating the head.

In another embodiment of the invention, the cap also is threadably mounted on the container, the head is pivotably mounted on the cap, and the valve is opened and closed by pivoting the head.

DETAILED DESCRIPTION

Figure 1:
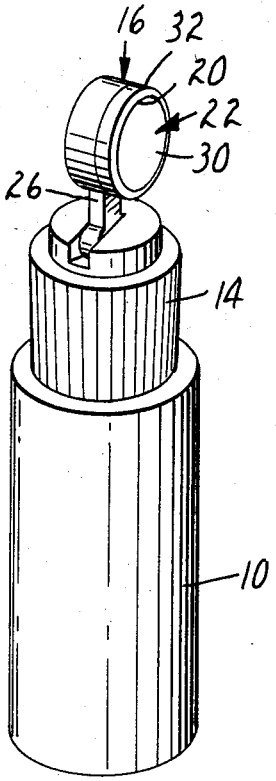
FIG. 1 is a schematic perspective view of a first cleaning device embodying the invention.
Figure 2:
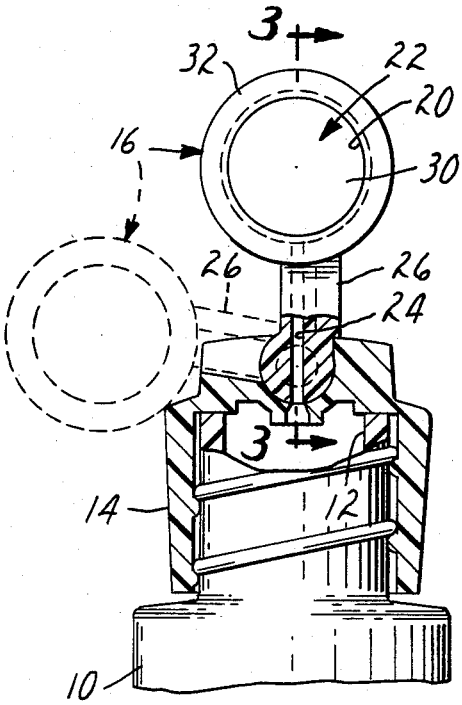
FIG. 2 is a cross-section along the axis of the cylindrical container of the first cleaning device of FIG. 1.

The cleaning device shown in FIGS. 1–4 consists of a plastic squeeze-bottle container 10 which is an elongated cylinder having an orifice 12 at one end of the cylinder, a plastic cap 14 screwed onto the container over its orifice, and a plastic head 16 pivotably mounted on the cap. The head 16 includes a substantially cylindrical reservoir 18 that opens to the exterior at an annular aperture 20. The reservoir and aperture are filled with a porous cleaning pad 22. The head 16 and cap 14 together form a valve by virtue of a narrow, cylindrical channel 24 which extends from the reservoir 18 through the neck 26 of the head 16 and opens into the bottle 10 when the head is in the upright position shown in FIG. 1 and in solid lines in FIG. 2. The channel 24 is closed by pivoting the head 16 to the sidewise dotted position of FIG. 2.

Figure 3:
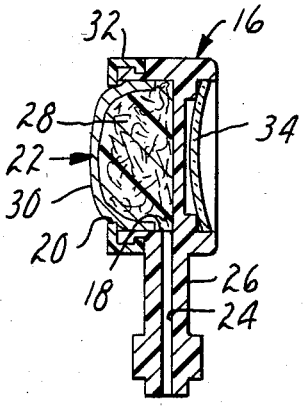
FIG. 3 is a cross-section of a disassembled head along line 3—3 of FIG. 2.
Figure 4:
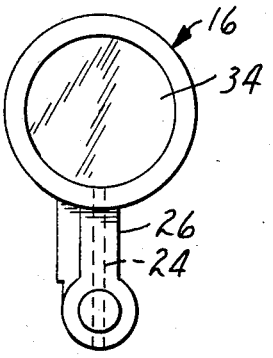
FIG. 4 is a plan view of the disassembled head of the first cleaning device.

As seen in FIG. 3, the porous cleaning pad 22 comprises a cylindrical, flexible, open-cell plastic foam core 28 such as polyurethane foam and an exterior, cut-pile fabric 30 such as velour which is held in place by a plastic collar 32. The exterior face of the fabric 30 extends generally parallel to the axis of the container 10. A mirror 34 is mounted within a depression in the opposite side of the head 16.

To use the cleaning device of FIGS. 1–4, the head 16 is moved to the upright position, and the container 10 is squeezed to fill the reservoir 18 with cleaning fluid, thus saturating the cleaning pad 22. The head may then be pivoted to the angled position, to prevent the flow of additional cleaning fluid into the head, and used in that position to clean and inspect a phonograph stylus. Alternatively the cleaning and inspection may be done with the head in the upright position if care is taken not to squeeze the container 10 while doing so unless additional cleaning fluid is desired to clean the stylus.

Figure 5:
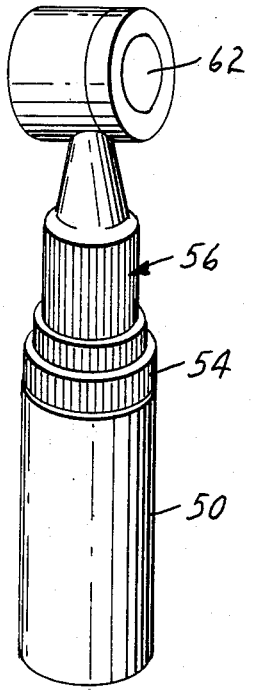
FIG. 5 is a schematic perspective view of a second cleaning device embodying the invention.
Figure 6:
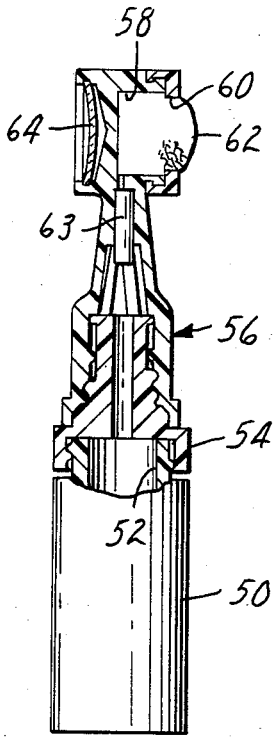
FIG. 6 is a cross-section along the axis of the cylindrical container of the second cleaning device of FIG. 5.

A preferred cleaning device shown in FIGS. 5 and 6 consists of a plastic squeeze-bottle container 50 which is an elongated cylinder having an orifice 52 at one end of the cylinder, a plastic cap 54 screwed onto the bottle over its orifice, and a plastic head 56 mounted on the cap. The head 56 includes a substantially cylindrical reservoir 58 and is formed with a circular aperture 60 from the reservoir to the exterior. The reservoir and aperture are filled with a porous cleaning pad 62 comprising a cylindrical, flexible open-cell plastic foam core and an exterior, cut-pile fabric. The head 56 and the cap 54 are threadably connected to provide a valve which is closed in the position shown in FIGS. 5 and 6 and is opened by rotating the head to lift it off the value stem 63.

A mirror 64 is mounted within a depression in the opposite side of the head 56. Preferably the mirrors 34 and 64 are concave to provide a magnified view of the stylus.

In each of the devices of FIGS. 1–4 and 5–6, the cap and head are preferably molded of a plastic which is both solvent and impact resistant. Especially suitable is a blend of a major proportion of ABS and a minor proportion of polyvinylchloride such as Mobay-89020. The squeeze-bottle containers 10 and 50 also must be solvent and impact resistant and preferably are blow-molded polypropylene.

A preferred cleaning fluid comprises by weight 80 parts of a fast-evaporating fluorocarbon such as "Freon TF", 15 parts of isopropyl alcohol and 5 parts of heptane plus small amounts of an anti-static agent and a lubricant totaling about 0.25 part. See U.S. Pat. No. 4,313,978 (Stevens et al.). The cleaning fluid may also contain a fluorinated surfactant as suggested in that patent.

Each of the reservoirs 18 and 58 preferably has a volume of 0.5 ml. When using the preferred cleaning fluid mentioned above, that amount is generally adequate to clean any phonograph stylus. If not, one can easily refill the reservoir and again clean the stylus.

I claim:

1. A phonograph stylus cleaning device comprising an elongated cylindrical plastic squeeze bottle cleaning-fluid container formed with an orifice, a cap mounted over the orifice, a head mounted on the cap, which head includes a small reservoir and is formed with an aperture from the reservoir to the exterior, the cap and head together forming a valve for allowing cleaning fluid to flow from the container to fill the reservoir, a porous cleaning pad filling said aperture to allow cleaning fluid in the reservoir to be applied to the phonograph stylus, said cleaning pad comprising a flexible foam core and an exterior cut pile fabric; and a magnifying mirror mounted on the head for viewing a stylus which has been cleaned.

2. Cleaning device as defined in claim 1 wherein the porous cleaning pad is coextensive with the reservoir.

3. Cleaning device as defined in claim 2 wherein the capacity of the reservoir is about 0.5 ml.

4. Cleaning device as defined in claim 1 wherein the cap is threadably mounted on the container, the head is rotatably mounted on the cap, and the valve is opened and closed by rotating the head.

5. Cleaning device as defined in claim 1 wherein the cap is threadably mounted on the container, the head is pivotably mounted on the cap, and the valve is opened and closed by pivoting the head.

6. Cleaning device as defined in claim 1 wherein each of the container, cap and head is a piece of molded plastic.

7. Cleaning device as defined in claim 1 wherein the squeeze bottle is an elongated cylinder and its orifice is at one end of the cylinder, and the exterior face of the cleaning pad extends generally parallel to the axis of the cylinder.

8. Cleaning device as defined in claim 1 wherein the foam core is polyurethane.

9. Cleaning device as defined in claim 1 wherein the cut-pile fabric is velour.

* * * * *